US007316291B2

(12) United States Patent
Thomsen et al.

(10) Patent No.: US 7,316,291 B2
(45) Date of Patent: Jan. 8, 2008

(54) SUCTION MUFFLER FOR A HERMETIC REFRIGERANT COMPRESSOR

(75) Inventors: Jan Thomsen, Aabenraa (DK); Preben Bjerre, Soenderborg (DK); Christian Svendsen, Krusaa (DK); Morten Svendsen, Roedekro (DK); Klaus Reinwand, Harrislee (DE)

(73) Assignee: Danfoss Compressors GmbH, Flensburg (DE)

( * ) Notice: Subject to any disclaimer, the term of this patent is extended or adjusted under 35 U.S.C. 154(b) by 292 days.

(21) Appl. No.: 10/844,905

(22) Filed: May 13, 2004

(65) Prior Publication Data

US 2005/0006172 A1 Jan. 13, 2005

(30) Foreign Application Priority Data

May 24, 2003 (DE) ..... 103 23 526

(51) Int. Cl.
*F02M 35/00* (2006.01)

(52) U.S. Cl. ..... 181/262; 181/403; 181/229; 181/262; 181/250; 417/312; 62/503

(58) Field of Classification Search ..... 181/403, 181/229, 262, 250, 273, 276; 417/312
See application file for complete search history.

(56) References Cited

U.S. PATENT DOCUMENTS 4,370,104 A * 1/1983 Nelson et al. ..... 417/312
4,412,791 A * 11/1983 Lal ..... 417/312
5,214,937 A * 6/1993 Henrichs et al. ..... 62/468
5,427,511 A * 6/1995 Caillat et al. ..... 418/55.1
5,542,824 A * 8/1996 Lee ..... 417/312
5,734,134 A * 3/1998 Park ..... 181/229
5,888,055 A 3/1999 Lee
6,017,197 A * 1/2000 Jensen et al. ..... 417/312
6,149,402 A * 11/2000 Kim ..... 417/312
6,358,019 B1 * 3/2002 Iversen et al. ..... 417/312
6,446,454 B1 * 9/2002 Lee et al. ..... 62/296
6,524,080 B1 * 2/2003 Chintamani et al. ..... 417/312
2003/0150670 A1 * 8/2003 Svendsen et al. ..... 181/262

* cited by examiner

*Primary Examiner*—Lincoln Donovan
*Assistant Examiner*—Forrest Phillips
(74) *Attorney, Agent, or Firm*—McCormick, Paulding & Huber LLP

(57) ABSTRACT

The invention concerns a suction muffler for a hermetic refrigerant compressor with a housing having an inlet and an outlet and limiting at least one muffling chamber, and a gas supply channel located in the muffling chamber between the inlet and the outlet. It is endeavoured to prevent too much oil from remaining in the refrigerant gas flow. For this purpose, the gas supply channel forms a throttling path and ends in the muffling chamber, and that in the area of the inlet of the gas supply channel an oil extraction opening is located, which ends in the muffling chamber.

15 Claims, 3 Drawing Sheets

SUCTION MUFFLER FOR A HERMETIC REFRIGERANT COMPRESSOR

CROSS-REFERENCE TO RELATED APPLICATIONS

This application is entitled to the benefit of and incorporates by reference essential subject matter disclosed in German Patent Application No. 103 23 526.4 filed on May 24, 2003.

FIELD OF THE INVENTION

The invention concerns a suction muffler for a hermetic refrigerant compressor with a housing having an inlet and an outlet and limiting at least one muffling chamber, and a gas supply channel located in the muffling chamber between the inlet and the outlet.

BACKGROUND OF THE INVENTION

Such a suction muffler is, for example, known from DE 195 22 383 A1. The gas supply channel is guided between two walls, which do not completely fill a clearance between two inner housing walls. Accordingly, the gas supply channel is connected with the muffling chamber over practically its whole length.

DE 199 23 734 C2 shows another suction muffler for a hermetically enclosed compressor, in which the muffling chamber is divided into two subchambers. The transition from one subchamber to the other subchamber takes place via a pipe. This pipe extends in the extension of an outlet opening of an inlet nozzle.

U.S. Pat. No. 4,370,104 shows an upright, cylinder-shaped suction muffler having a funnel shaped inlet nozzle, with which the suction gas can be sucked from the inside of a case enclosing the refrigerant compressor. An inlet line is guided through the wall of the case in such a manner that it faces the funnel shaped inlet nozzle.

In hermetic refrigerant compressors, the parts, which move in relation to each other, are usually lubricated by means of oil. In the actual compression stage, in which a piston reciprocates in a cylinder, the oil usually has the additional function of providing an improved sealing of the inner cylinder chamber. Thus, it cannot be avoided that the refrigerant gas gets in touch with the oil and, at least partly, carries along oil. However, it is endeavoured to avoid that the amount of oil, which is carried along by the refrigerant gas flow, gets too large. Firstly, this oil is then missing for the lubrication of the compressor. Secondly, oil settling on heat exchanger surfaces hinders the heat transfer at these places.

SUMMARY OF THE INVENTION

The invention is based on the task of preventing too much oil from remaining in the refrigerant gas flow.

With a suction muffler as mentioned in the introduction, this task is solved in that the gas supply channel forms a throttling path and ends in the muffling chamber, and that in the area of the inlet of the gas supply channel an oil extraction opening is located, which ends in the muffling chamber.

With this embodiment, it is considered that a pressure difference occurs between the beginning of the gas supply channel and the end of the gas supply channel, when the refrigerant gas flows through the gas supply channel. Thus, the pressure at the beginning of the gas supply channel is higher than the pressure at the end of the gas supply channel. The pressure at the end of the gas supply channel also rules in the muffling chamber, as a throttling practically no longer exists between the end of the gas supply channel and the muffling chamber. In other words, between the end of the gas supply channel and the inside of the muffling chamber a sufficiently large cross-section is available, through which a pressure equalisation can be effected. Between the beginning of the gas supply channel and the muffling chamber an oil extraction opening is located. Truly, this oil extraction opening permits a transfer of a small amount of refrigerant gas and particularly of oil from a flow section of the refrigerant gas into the inside of the muffling chamber. However, it permits no pressure equalisation between the beginning of the gas supply channel and the inside of the muffling chamber. Oil supplied together with the refrigerant gas will in many cases settle as a thin film on the walls of the piping, through which the refrigerant gas flows. Only a small share is transported in the real gas flow in the form of small droplets. Due to the pressure difference between the beginning of the gas supply channel and the inside of the muffling chamber, a suction occurs through the oil extraction opening, through which oil reaching the area of the oil extraction opening is extracted. Thus, this oil is also removed from the inner wall of the piping, through which the refrigerant gas flows. Thus, the pressure drop, to which the gas is exposed when flowing through the gas supply channel, is used to lead off oil from the flow path of the gas to more quiet areas in the inside of the muffling chamber. The pressure drop namely also rules over the oil extraction opening.

Preferably, the oil extraction opening is formed by a gap between the housing and the inlet of the gas supply channel. This facilitates the manufacturing. A separate opening does not have to be provided in the wall of the gas supply channel, but a gap can be used, which is formed between the front side of the gas supply channel and the housing. This gap has several advantages. Firstly, it is no longer necessary that the oil to be extracted abuts at the bottom in the gravity direction. On the contrary, also such oil is sucked off, which is located on other areas of an inner wall of a piping, through which the refrigerant gas is supplied. Secondly, a gap can be very small, so here only oil can pass, however a pressure equalisation does not occur.

Preferably, an outlet nozzle is located opposite the end of the gas supply channel, said outlet nozzle forming a gas path leaving the housing. The refrigerant gas, which is supplied through the gas supply channel, can trespass relatively fast into the outlet nozzle. Thus, the stay duration of the refrigerant gas in the suction muffler is kept small. Thus, it is avoided that the refrigerant gas is heated because of a long stay in the suction muffler. The colder the refrigerant gas can be kept, when it reaches the real compression stage of the refrigerant compressor, the higher is the efficiency. The gas supply channel does not extend directly into the outlet nozzle. Between the gas supply channel and the outlet nozzle a clearance exists, which is sufficient to effect a pressure equalisation between the muffling chamber and the end of the gas supply channel.

It is also preferred that the outlet nozzle has an expanded inlet. Firstly, this keeps the scattering losses small. The refrigerant gas leaving the end of the gas supply channel is reliably caught by the expansion. Secondly, this "funnel" can cause a further pressure reduction of the muffling chamber directly at the beginning of the suction stroke, when refrigerant gas is sucked off from the muffling chamber. The increased mass flow from the muffling chamber reduces the pressure ruling herein. The lower the pressure in the muffling chamber is, the better is the oil extraction.

Preferably, the gas supply channel has at least one directional change. This has several advantages. Firstly, oil that is carried along by the refrigerant gas flow can settle on the wall of the gas supply channel during a directional change. Secondly, a directional change increases the pressure drop, so that the pressure at the end of the gas supply channel can be made even smaller. In principle, a pressure drop can also be effected in other ways, with a straight course of the gas supply channel, for example, through a slight narrowing of the channel cross-section. However, measures are preferred, which do not increase the flow resistance too much.

Preferably, the gas supply channel is located in a closed pipe. Thus, the pipe forms a component, which can be handled separately. This facilitates the manufacturing of the housing of the suction muffler.

Preferably, the pipe has outwardly projecting lugs, with which it is suspended in the housing. This is a simple way of ensuring a reliable fixing of the pipe in the housing. The inner wall of the housing merely has to be provided with grooves or recesses, with which the lugs can engage.

It is also advantageous that the pipe has a projecting oil drip-off edge, which is located at a certain distance from its inlet. When oil settles on the outer wall of the pipe and runs downwards, the oil is guided by the oil drip-off edge and is kept far away from the inlet of the pipe. Thus, it is avoided that this already separated oil gets back into the refrigerant flow.

Preferably, the area of the inlet of the pipe bears on a support face, which is formed in the housing in the area of its inlet. The housing has an inlet opening, through which the refrigerant gas flows in. In the flow direction of the refrigerant gas, after the inlet opening, the support face is formed inside the housing, that is, in the muffling chamber. This support face makes it possible to position the inlet of the pipe relatively accurately in relation to the inlet opening of the housing. In this connection, the support face permits the forming of the gap mentioned above, which forms the oil extraction opening. In other words, it is not necessary for the whole surface of the inlet of the pipe to meet with inner wall of the housing. On the contrary, a small gap must remain, which enables the inflow of oil into the muffling chamber.

Preferably, the pipe is formed by at least two pipe shells. These pipe shells can be clipped together. This facilitates the manufacturing of the pipe. The pipe can be formed by die-castings, not requiring cores to be provided, which would eventually keep the gas supply channel free.

Preferably, the outside of the housing is provided with a plane bearing surface, which surrounds the inlet. A front-side flange of a supply line for the refrigerant gas can bear on this bearing surface. The fact that the bearing surface is plane enables lateral displacements between the supply line and the suction muffler, without interfering with the tightness of the connection between the supply line and the suction muffler.

It is particularly preferred that an oil shield is located above the bearing surface. Oil, which settles on the outside of the housing and then runs downwards because of gravity, will then not reach the area of the inlet opening of the housing, but will be led around it on the outside because of the oil shield. At the lower end of the housing, the oil can then drop into an oil sump formed in the compressor housing.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figure 1:
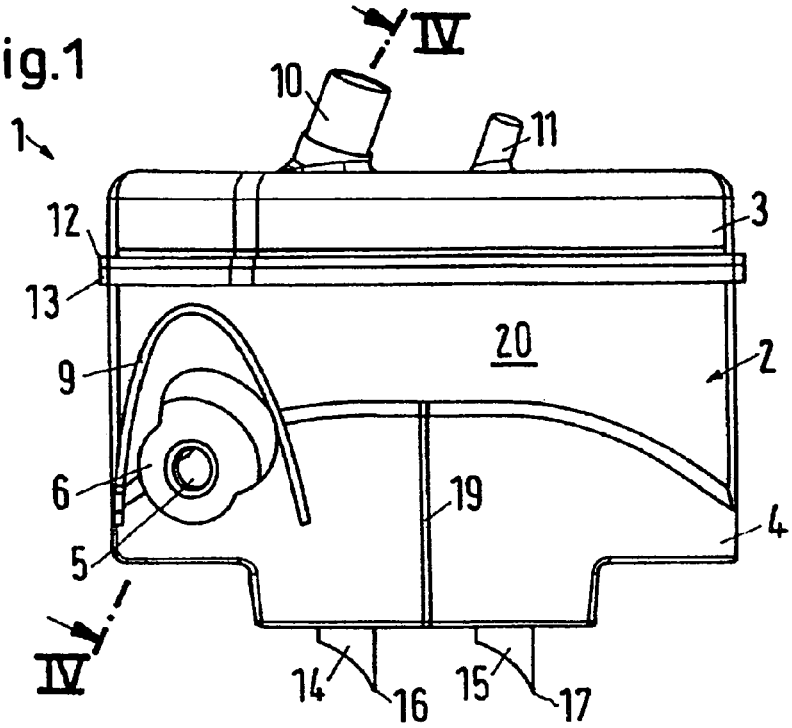
FIG. 1 is an outside view of a suction muffler
Figure 2:
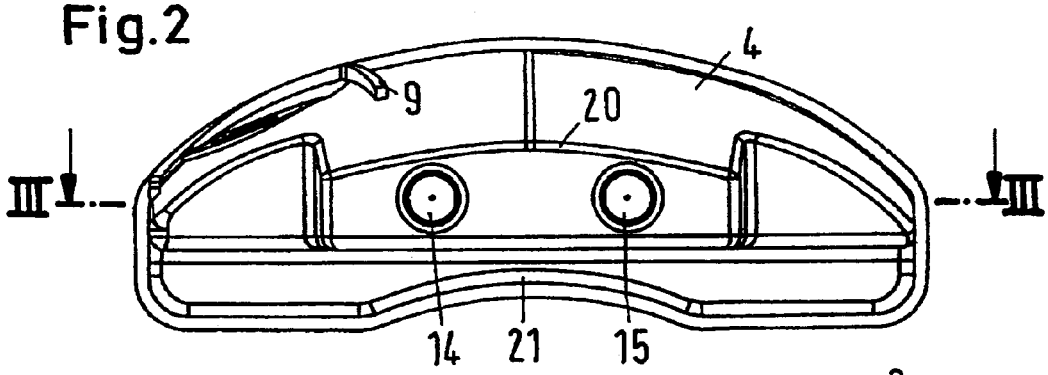
FIG. 2 is a bottom view of the suction muffler

A suction muffler 1 has a housing 2, which is formed by a top part 3 and a bottom part 4. The bottom part has an inlet 5 in the form of an opening in the wall of the housing 2. The inlet 5 is surrounded by a plane bearing surface 6, on which a supply line 7 (FIG. 4) with a bearing flange 8 bears with a certain force. Between the supply line 7 and the suction muffler 1, a certain relative movement is possible without causing the closing of a passage between the supply line 7 and the inlet 5.

An oil shield 9 having the shape of an arch is located above the inlet 5. Oil, which settles on the outside of the housing and runs downwards under the influence of the gravity, is prevented from getting into the inlet 5 by the oil shield 9.

On its upper side the top part 3 has an outlet nozzle 10, on which a connection line to the compressor stage of a refrigerant compressor can be fixed in a manner not shown in detail. Further, a mounting lug 11 is provided, which can be used for fixing the suction muffler 1 on a cylinder head cover.

Figure 4:
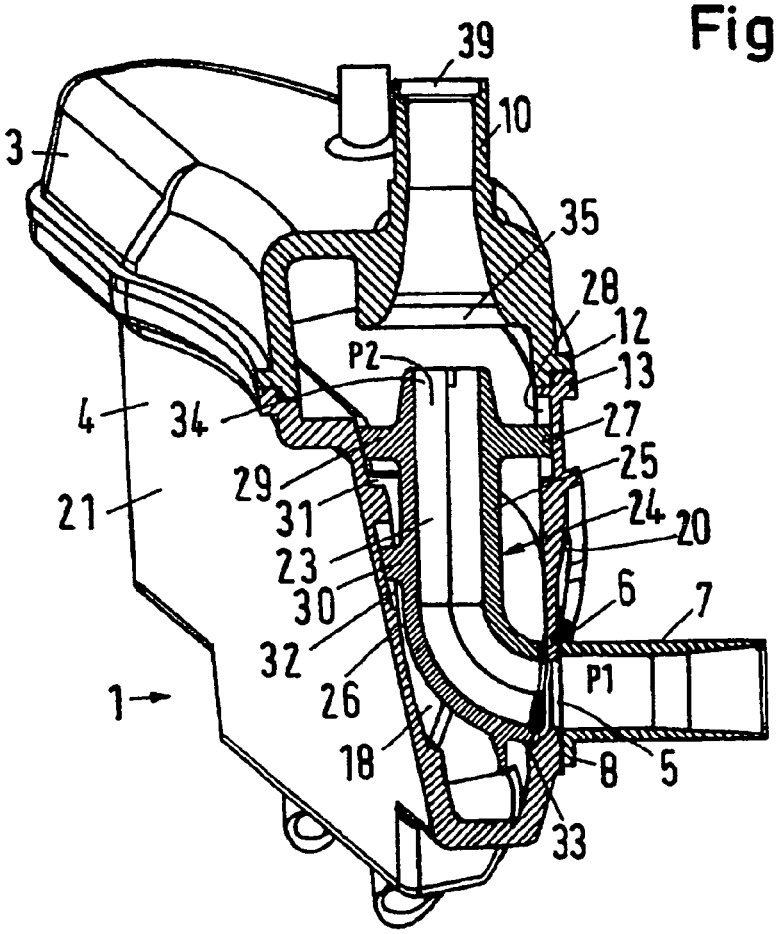
FIG. 4 is the suction muffler, partly in section

The top part 3 and the bottom part 4 each have an upper open flange 12, 13, which can, as can be seen from FIG. 4, have gradations, which are adapted to each other. In the area of these flanges 12, 13, the top part 3 and the bottom part 4 are connected with each other, for example by means of welding or gluing.

From the bottom of the bottom part, two oil outlets 14, 15 project downwards, each having an oil drip-off edge 16, 17.

The housing 2 surrounds a muffling chamber 18. The muffling chamber 18 practically completely fills up the inside of the housing 2, that is, only one single muffling chamber 18 is provided in the suction muffler 1.

A stiffening wall section 19 divides the muffling chamber 18 into two parts. The stiffening wall section 19 connects the front wall 20 with the rear wall 21 of the bottom part 4; however, it does not extend over the whole height of the muffling chamber 18, so that the two sections of the muffling chamber 18 are connected with each other via a connection 22.

Figure 3:
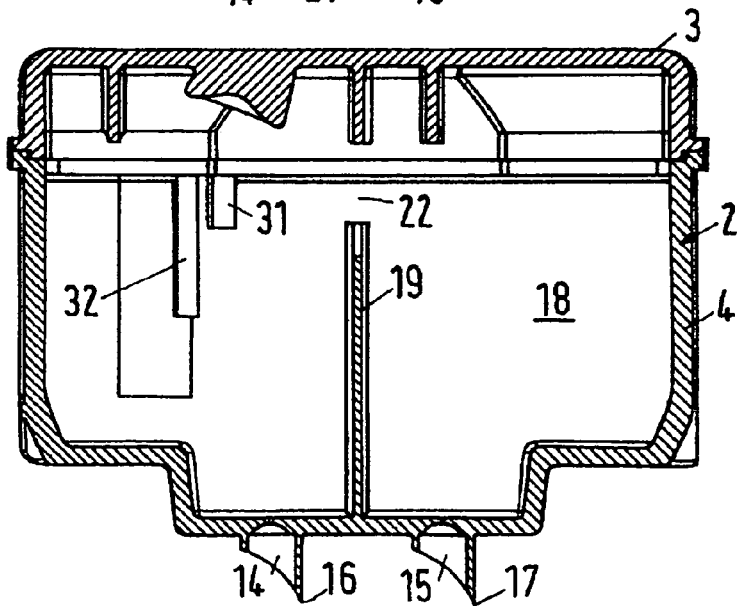
FIG. 3 is a section III-III according to FIG. 2

A closed gas supply channel 23 is formed in a pipe 24. The pipe 24 has an upper pipe shell 25 and a lower pipe shell 26. The upper pipe shell 25 has a lug 27, which engages in a recess 28 in the front wall 20. The lower pipe shell 26 has two lugs 29, 30, which engage in corresponding recesses 31, 32 in the rear housing wall 21. The recesses 31, 32 can be seen in FIG. 3. The section level in FIG. 4 extends along the line IV-IV according to FIG. 1.

The gas supply channel 23 has a directional change of approximately 90°. Gas, which is supplied substantially horizontally through the supply line 7, is deflected upwards through the gas supply channel 23. This, and the length of the gas supply channel 23 make the gas supply line form a throttling path, which causes a pressure drop in the gas flowing through.

Accordingly, a pressure P1 rules at the inlet 33 of the gas supply channel 23, whereas a pressure P2 rules at the outlet 34. Accordingly, the pressure P2 also rules in the muffling chamber 18, as the gas supply channel 23 is closed and the outlet 34 ends freely in the muffling chamber 18, and practically no throttlings are available between the muffling chamber 18 and the outlet 34.

The outlet 34 is arranged opposite to the outlet nozzle 10, which has an expanded inlet 35. Gas escaping through the outlet 34 of the gas supply channel 23 can enter the inlet 35 of the outlet nozzle 10 with practically no loss. Through the expansion in the form of a funnel the gas is caught, that is, the possibility of gas spreading parasitally in the muffling chamber is relatively small. Under certain circumstances, the transition between the outlet 34 and the inlet 35 can cause a further pressure reduction in the muffling chamber 18.

Figure 5:
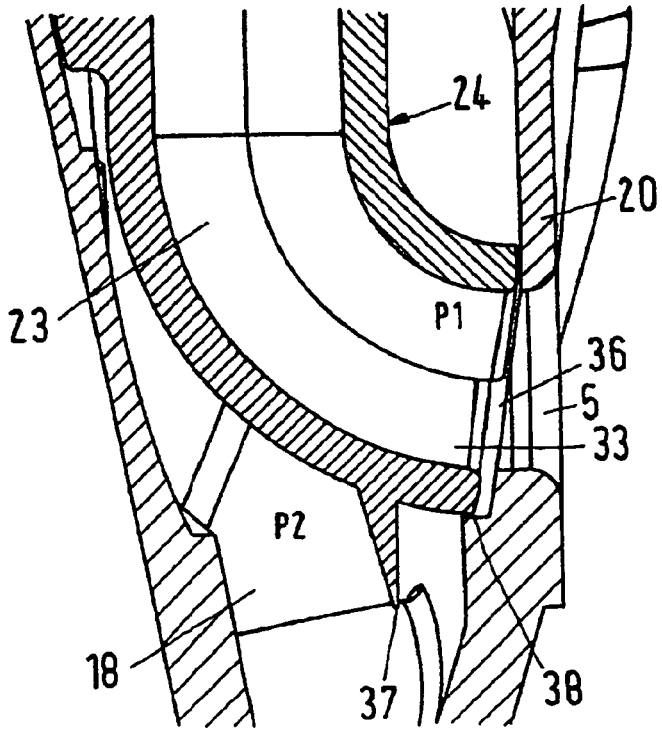
FIG. 5 is an enlarged part view from FIG. 4

As can be seen, particularly from FIG. 5, the pipe does not bear tightly on the front wall 20. Between the inlet 33 of the pipe 24 and the front wall 20 an oil extraction opening exists in the form of a throttling gap 36. Oil, which settles on the inner wall of the supply line 7 and is carried along by the flow of refrigerant gas in the direction of the inlet 5 of the housing, then does not reach the gas supply channel 23 inside the pipe, but is sucked off into the muffling chamber 18 by the pressure difference between P1 at the inlet 33 of the gas supply channel 23 and the pressure P2 in the muffling chamber 18. Thus, at least a share of the oil is removed from the refrigerant gas flow.

At its lower end in the gravity direction, the pipe 24 has an oil drip-off edge 37. This oil drip-off edge 37 is located in the area of the inlet 33 of the gas supply channel 23, however, with a predetermined distance to this area. Oil, which settles on the outside of the pipe 24 and runs downwards, does then not reach the area of the inlet 33, but drops via the oil drip-off edge 37 into the muffling chamber 18.

As mentioned above, the pipe 24 is retained in the bottom part 4 by means of its lugs 27, 29, 30. A fixing in the height occurs in that the pipe 24 bears on a bearing surface 38, which is formed in the front wall 20 of the bottom part and serves as a support face for the inlet 33 of the pipe 24. The bearing surface 38 is made in the way of a step. Through this fixing of the pipe 24 in the housing, it is achieved that the oil extraction opening 36 can be kept open in a simple way.

Refrigerant gas, which is supplied via the supply line 7, flows through the gas supply channel 23 and reaches the outlet 39 of the suction muffler 1 via the outlet nozzle 10. Thus, dwell times of the refrigerant gas in the suction muffler 1 are kept short. The heating of the refrigerant gas inside the suction muffler 1 is practically not worth mentioning.

Oil, which settles on the inner wall of the supply line 7, can advance to the inlet 5. However, due to the pressure difference P1-P2 between the inlet 5 and muffling chamber 18, it is sucked into the muffling chamber 18. The throttling path of the gas supply channel 23 generates this pressure difference.

Figure 6:
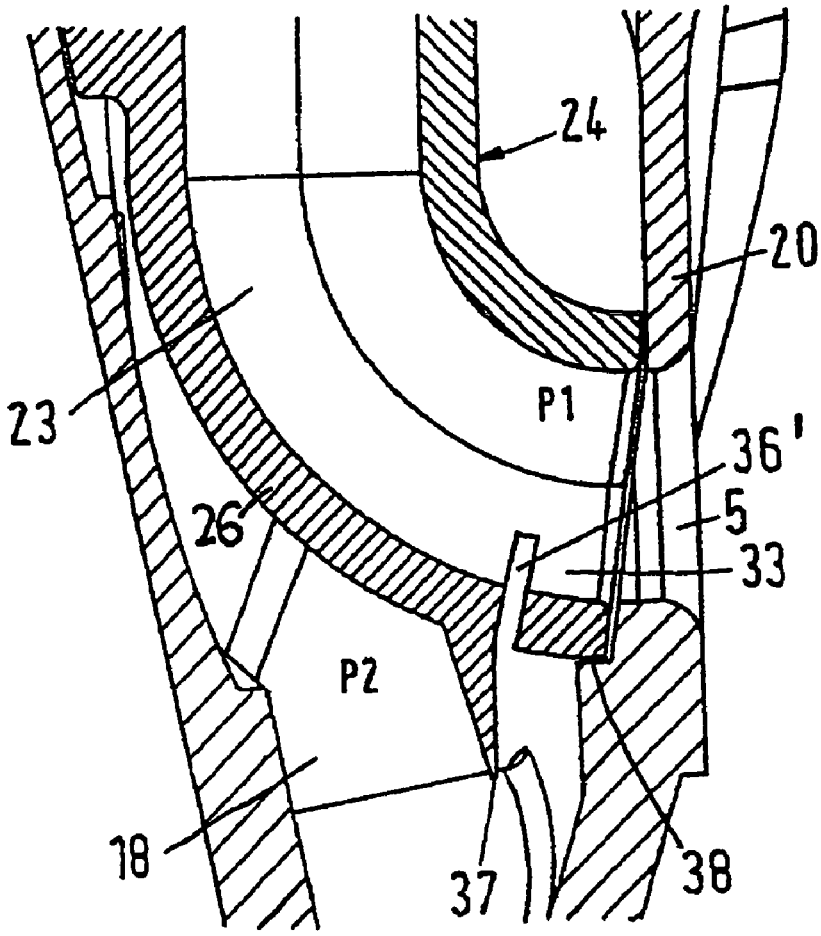
FIG. 6 is a modified embodiment of FIG. 5

FIG. 6 shows an embodiment similar to that of FIG. 5. Same parts have the same reference numbers.

In the embodiment according to FIG. 6, the throttling gap 36 is no longer formed between the housing 2 and the pipe 24, but exists as a separate gap 36' in the lower pipe shell 26. However, the throttling gap 36' is still located as an oil extraction opening in the area of the inlet 33 of the gas supply channel 23. Thus, the effects of the throttling gap 36' are the same as the effects of the throttling gap 36 of the embodiment according to FIG. 5.

What is claimed is:

1. A suction muffler for a hermetic refrigerant compressor comprising:

a housing having an inlet and an outlet and limiting at least one muffling chamber; and a gas supply channel located in the muffling chamber between the inlet and the outlet, the gas supply channel forming a throttling path and ending in the muffling chamber;

wherein, in the area of the inlet of the gas supply channel, an oil extraction opening is located, which ends in the muffling chamber.

2. The suction muffler according to claim 1, wherein the oil extraction opening is formed by a throttling gap between the housing and the inlet of the gas supply channel.

3. The suction muffler according to claim 1, wherein an outlet nozzle is located opposite the end of the gas supply channel, said outlet nozzle forming a gas path leaving the housing.

4. The suction muffler according to claim 3, wherein the outlet nozzle has an expanded inlet.

5. The suction muffler according to claim 1, wherein the gas supply channel has at least one directional change.

6. The suction muffler according to claim 1, wherein the gas supply channel is located in a closed pipe.

7. The suction muffler according to claim 6, wherein the pipe has outwardly projecting lugs, with which the pipe is suspended in the housing.

8. The suction muffler according to claim 6, wherein the pipe has a projecting oil drip-off edge, which is located at a certain distance from an inlet of the pipe.

9. The suction muffler according to claim 6, wherein the area of the inlet of the pipe bears on a support face, which is formed in the housing in the area of the inlet of the housing.

10. The suction muffler according to claim 6, wherein the pipe is formed by at least two pipe shells.

11. The suction muffler according to claim 1, wherein the outside of the housing is provided with a plane bearing surface, which surrounds the inlet.

12. The suction muffler according to claim 11, wherein an oil shield is located above the bearing surface.

13. The suction muffler according to claim 6, wherein the oil extraction opening is formed by a throttling gap in the pipe.

14. The suction muffler according to claim 10, wherein the oil extraction opening is formed by a throttling gap in a lower of the at least two pipe shells.

15. The suction muffler according to claim 1, wherein oil extracted through the oil extraction opening from the gas supply channel is led to quieter areas inside the muffling chamber.

* * * * *